US006740138B2

(12) United States Patent
Amano et al.

(10) Patent No.: US 6,740,138 B2
(45) Date of Patent: May 25, 2004

(54) MOLTEN STEEL PRODUCING METHOD

(75) Inventors: Hajime Amano, Chita (JP); Akihiro Nagatani, Toukai (JP); Atushi Hattori, Toukai (JP)

(73) Assignee: Daido Tokushukou Kabushikikaisha (JP)

( * ) Notice: Subject to any disclaimer, the term of this patent is extended or adjusted under 35 U.S.C. 154(b) by 57 days.

(21) Appl. No.: 10/151,257

(22) Filed: May 21, 2002

(65) Prior Publication Data

US 2003/0024349 A1 Feb. 6, 2003

(30) Foreign Application Priority Data

May 29, 2001 (JP) ..... 2001-161385
Nov. 30, 2001 (JP) ..... 2001-367571

(51) Int. Cl.[7] ..... C21B 13/12
(52) U.S. Cl. ..... 75/10.66
(58) Field of Search ..... 75/10.66

(56) References Cited

U.S. PATENT DOCUMENTS 4,419,128 A 12/1983 Nakagawa et al. ..... 75/46
4,867,787 A 9/1989 Pühringer et al. ..... 75/38
6,162,274 A * 12/2000 Kamikawa et al. ..... 75/10.1

FOREIGN PATENT DOCUMENTS

| | | |
|---|---|---|
| DE | 1 533 931 | 2/1970 |
| JP | 63-247309 | 10/1988 |
| JP | 6-287621 | 10/1994 |
| JP | 8-109408 | 4/1996 |

* cited by examiner

*Primary Examiner*—Melvyn Andrews
(74) *Attorney, Agent, or Firm*—Parkhurst & Wendel, L.L.P.

(57) ABSTRACT

A method of producing a molten steel, including the steps of putting, in an electric furnace, an iron material and a carbon material, to melt the iron material and the carbon material and produce a high-carbon molten iron whose carbon content is not lower than 1%, storing, in a reservoir furnace whose capacity is larger than a capacity of the electric furnace, an amount of the high-carbon molten iron that corresponds to a plurality of charges of the electric furnace, and using a portion of the high-carbon molten iron stored in the reservoir furnace, to produce the molten steel in a steel producing furnace.

5 Claims, 5 Drawing Sheets

10
ELECTRIC FURNACE
12
14
LADLE

DAYTIME
NIGHTTIME
16
12
STORAGE IN RESERVOIR FURNACE

DAYTIME MELTING
22
20
18

[Cu] DISPERSION IN CONVENTIONAL HIGH-[C] MOLTEN STEELS

[Cu] DISPERSION IN HIGH-[C] MOLTEN STEELS OBTAINED BY MIXED MELTING (INVENTION PROCESS)

MOLTEN STEEL PRODUCING METHOD

BACKGROUND OF THE INVENTION

1. Field of the Invention

The present invention relates to a molten steel producing method and particularly to a method of storing a high-carbon molten bath in a reservoir furnace and using the stored molten bath to produce a molten steel in a steel producing furnace.

2. Discussion of Related Art

There are two molten-steel producing methods that are widely practiced; one is so-called blast-furnace-converter process in which iron ore and coke are put in a blast furnace so as to be molten and reduced at high temperature and the thus obtained hot metal whose C content is high is transferred to a converter in which oxygen is blown into the hot metal to decarbonize the metal and produce a molten steel; and the other is electric-furnace process in which scrap is molten in an electric furnace so as to produce a molten steel.

In the latter, electric-furnace process, scrap obtained from, e.g., waste cars, and a slag-producing material such as calcium oxide are put in an electric furnace such as an arc furnace, and electric power is applied to the electric furnace to melt the scrap.

Subsequently, usually, oxygen is blown into the molten steel to remove phosphorus and other impurities, and the concentration of carbon of the molten steel is adjusted.

Then, the molten steel is further heated, and the electric furnace is tilted to output a core portion of the molten steel and remove the slag on the molten steel.

In the former, blast-furnace-converter process, since iron ore is used as the starting material (the iron material), a lot of energy is needed to reduce the iron ore in producing hot metal. In addition, a large equipment is needed. Thus, the equipment cost, the maintenance cost, and the running cost are high.

Moreover, in the former process, the operation of the blast furnace is a continuous operation in which hot metal is continuously outputted from the furnace. Thus, it is substantially impossible to produce only a needed amount of hot metal, i.e., molten steel, at only a timing when the hot metal is needed.

In contrast, in the latter, electric-furnace process, since, usually, scrap is used as the iron material, the energy needed to melt the scrap is less than the energy needed when iron ore is used, by an amount needed to reduce the iron ore. In addition, an equipment needed to perform the latter process is simpler. Thus, the equipment cost, the maintenance cost, and the running cost are lower. Moreover, since the latter process is carried out on a batch basis, it is possible to produce, depending upon the economical circumstances, only a needed amount of molten steel, at only a timing when the steel is needed.

Furthermore, the latter process can be carried out in the nighttime when electric power costs low.

Since the cost of the molten-metal producing process using the electric furnace largely depends on the electric-power cost, the cost of the process can be reduced by operating the electric furnace in the nighttime.

However, it is practically difficult to carry out the process using the electric furnace, all in the nighttime, and at least a portion of the process is carried out also in the daytime when the electric power costs high.

In addition, the molten-steel producing method using the electric furnace cannot help using scrap having a certain quality, for the purpose of producing a final product having a certain quality. This is why the cost of production of molten steel according to this method is high.

That is, it is practically impossible to use, as the iron material, lower scrap that contain much impurities or whose impurities may largely change, or use the lower scrap in a much amount in combination with other sorts of scrap.

Moreover, in the molten-steel producing method using the electric furnace, it is desirable to use scale that has been disposed off, because the scale discarded can be utilized and the cost of production of molten steel can be lowered. However, in the conventional molten-steel producing method, the scale cannot be used as the iron material.

The scale essentially consists of iron oxides such as wustite, magnetite, hematite, etc. that are produced on the surfaces of iron or steel, e.g., when iron or steel is subjected to hot rolling or cast iron is subjected to soaking. Usually, the scale is removed from the iron or steel by acid cleaning, cutting, etc., and then it is discarded.

The Fe content of the scale is about 70 to 80 wt %. Therefore, if the scale can be used as an iron material for producing a molten steel, the cost of production of molten steel can be lowered. However, the scale essentially consists of the iron oxides, and the electric furnace that can melt the scale cannot reduce the scale or recover the Fe component. Thus, in the conventional molten-steel producing method using the electric furnace, the scale cannot be used.

SUMMARY OF THE INVENTION

It is therefore an object of the present invention to provide a molten-steel producing method that is free of the above-indicated problem.

According to a first feature of the present invention, there is provided a method of producing a molten steel, comprising the steps of putting, in an electric furnace, an iron material and a carbon material, to melt the iron material and the carbon material and thereby produce a high-carbon molten iron whose carbon content is not lower than 1%, storing, in a reservoir furnace whose capacity is larger than a capacity of the electric furnace, an amount of the high-carbon molten iron that corresponds to a plurality of charges of the electric furnace, and using a portion of the high-carbon molten iron stored in the reservoir furnace, to produce the molten steel in a steel producing furnace.

According to the present invention, an iron material and a carbon material such as breeze or coal are put in an electric furnace, and a high-carbon molten iron whose carbon content is not lower than 1% is produced in the electric furnace. The high-carbon molten iron produced is temporarily stored in a reservoir furnace, and a portion of the high-carbon molten iron stored in the reservoir furnace is taken and used to produce a molten steel in a steel producing furnace.

Thus, according to the present invention, the high-carbon molten iron can be produced in the electric furnace in the nighttime when electric power costs low, so that the molten iron produced may be stored in the reservoir furnace. The high-carbon molten iron stored in the reservoir furnace can be used to produce the molten steel in the steel producing furnace, in the daytime when the electric power costs high.

According to a second feature of the present invention that includes the first feature, the step of using the high-carbon molten iron to produce the molten steel, comprises putting the high-carbon molten iron, and scrap, in the steel producing furnace to produce the molten steel.

According to this feature, when the high-carbon molten iron is used to produce the molten steel in the steel producing furnace, the high-carbon molten iron and another sort of iron material, i.e., scrap are put in the steel producing furnace, and are molten in mixture. In this case, since the latent heat of the high-carbon molten iron, that is, the thermal energy of the molten iron, and the heat of reaction produced when the molten iron is decarbonized and CO and $CO_2$ gases are produced, are effectively utilized, the molten steel can be produced, with reduced energy, in the steel producing furnace.

Since the high-carbon molten iron can be produced in the nighttime when the electric power costs low, the total energy needed to produce the molten steel can be reduced, which contributes to reducing the cost of the electric power needed to produce the molten steel.

The above-indicated advantage results from the present molten-steel producing method including the steps in which the high-carbon molten iron is produced using the electric furnace, is stored in the reservoir furnace, and is used to produce the molten steel in the steel producing furnace.

The reason why the C content of the high-carbon molten iron is not lower than 1% is as follows: If the C content is lower than 1%, then it is substantially impossible to transfer the high-carbon molten iron from the electric furnace to the reservoir furnace and store the molten iron in the reservoir furnace for a certain time.

The melting point of the high-carbon molten iron changes with the C content thereof, such that as the C content increases, the melting point lowers and accordingly the molten iron becomes harder to solidify. Therefore, a storable time in which the molten iron can be stored in the reservoir furnace increases.

Here, the storable time (a storage time including, e.g., respective handling times needed to transfer the high-carbon molten iron from the electric furnace to the reservoir furnace and to transfer the molten iron from the reservoir furnace to the steel producing furnace (e.g., an electric furnace)) needs to be not less than 1 hour, and the present inventors' studies have elucidated that when the C content is not lower than 1%, the high-carbon molten iron can be stored for a time not less than 1 hour.

This is why the present invention requires that the C content of the high-carbon molten iron be not lower than 1%.

According to the present invention, the temperature of the high-carbon molten iron can be easily controlled because the high-carbon molten iron is molten and produced in the electric furnace. Thus, the high-carbon molten iron can be advantageously outputted at a high temperature.

For example, when a hot metal as a high-carbon molten steel is outputted from a blast furnace, the temperature of the hot metal is about 1,300 to 1,350° C. In contrast, according to the present invention, the high-carbon molten iron can be outputted, from the electric furnace, at a high temperature of, e.g., 1,500° C.

Since the high-carbon molten iron can be outputted at the high temperature, a storable time in which the molten iron can be stored in the reservoir furnace can be increased.

Thus, according to the present invention, a time when, and an amount in which, a molten steel is produced in the steps in which the high-carbon molten iron is produced using the electric furnace, is stored in the reservoir furnace, and is used to produce the molten steel in the steel producing furnace, can be easily controlled depending upon the economical circumstances.

According to a third feature of the present invention that includes the first or second feature, the steel producing furnace comprises an electric furnace.

According to this feature, when the high-carbon molten iron taken from the reservoir furnace is used to produce the molten steel in the steel producing furnace, an electric furnace can be used as the steel producing furnace.

As described above, the high-carbon molten iron may be mixed, and molten, with scrap in the electric furnace so as to produce a molten steel. The energy needed to produce the molten steel in the electric furnace, i.e., the electric power can be reduced.

However, according to the present invention, the steel producing furnace may be provided by a different sort of furnace than the electric furnace.

For example, a high-carbon molten iron whose C content is about 1.5% may be transferred as a seed bath to an AOD furnace (a steel producing furnace), so that the molten iron is decarbonized and smelted in the furnace to produce a stainless steel.

Since the high-carbon molten iron whose C content is about 1.5% can be stored in the reservoir furnace for about 10 hours, as described later, the high-carbon molten iron can be used, according to the present invention, to produce a stainless steel while enjoying the advantages of the present invention.

The present invention is essentially characterized in that when the high-carbon molten iron taken from the electric furnace is stored in the reservoir furnace, an amount of the high-carbon molten iron that corresponds to a plurality of charges of the electric furnace is simultaneously stored in the reservoir furnace, and a portion of the high-carbon molten iron stored in the reservoir furnace is used to produce a molten steel in the steel producing furnace.

It is possible to store, in the reservoir furnace, an amount of the high-carbon molten iron that corresponds to just one charge of the electric furnace and use all the high-carbon molten iron stored in the reservoir furnace, to produce a molten steel in the steel producing furnace.

In this case, however, dispersion in respective compositions of the respective charges of high-carbon molten iron, each produced in the electric furnace, directly influence quality of the molten steels produced in the steel producing furnace.

In contrast, according to the present invention, an amount of the high-carbon molten iron that corresponds to a plurality of charges of the electric furnace is simultaneously stored in the reservoir furnace, and accordingly the respective compositions of the respective charges of high-carbon molten iron are averaged in the reservoir furnace.

For example, in the case where an amount of the high-carbon molten iron that corresponds to 8 charges of the electric furnace is stored in the reservoir furnace, the respective compositions of the 8 charges of high-carbon molten iron are averaged in the reservoir furnace and the dispersion in those compositions is leveled off.

Thus, when a portion of the high-carbon molten iron stored in the reservoir furnace is outputted, the composition of the portion outputted is equal to the averaged composition.

Therefore, according to the present invention, it is possible to use lower scrap that has the problem that respective compositions of different batches thereof largely differ from each other and accordingly cannot be used in the conventional methods, or to use the lower scrap in a greater proportion in combination with one or more different sorts of iron materials.

According to a fourth feature of the present invention that includes any of the first to third features, the step of putting the iron material and the carbon material to produce the high-carbon molten iron, comprises putting scrap as the iron material.

According to this feature, when a high-carbon molten iron is produced using the electric furnace, scrap can be used. More specifically described, lower scrap that has the problem that impurities of one batch thereof largely differ from those of another batch thereof can be used, or the lower scrap can be used in a greater proportion in combination with one or more different sorts of iron material. In addition, when a molten steel is produced in the steel producing furnace in the final step, the lower scrap can be used as an iron material, or can be used in a greater proportion in combination with one or more different sorts of iron material.

Thus, according to this feature, the cost of production of molten steel can be lowered while the quality of the molten steel produced is maintained at a high level.

According to a fifth feature of the present invention that includes the fourth feature, the step of putting the iron material and the carbon material to produce the high-carbon molten iron, comprises putting scrap and scale as the iron material.

According to this feature, when a high-carbon molten iron is produced using the electric furnace, scale can be used together with scrap.

That is, scale that has been disposed off can be used as a material for producing steel, which contributes to lowering the cost of the materials needed to produce steel.

Since, in the high-carbon-molten-iron producing process using the electric furnace, the carbon material is input together with the iron material, the scale as the iron oxides can be reduced by the carbon material, and accordingly the Fe component can be efficiently recovered. This is another advantage of the present invention.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Hereinafter, there will be described embodiments of the present invention, by reference to the drawings.

FIG. 1 shows an arc furnace (i.e., electric furnace) 10 in which scrap as iron material, and carbon material (e.g., breeze or coal) are put and are subjected to arc melting to obtain a high-carbon molten iron or bath 12 whose C (carbon) content is not lower than 1%.

From a hearth of the arc furnace 10, inert gas such as nitrogen gas or argon gas is blown into the high-carbon molten bath 12 to agitate the same 12.

When the high-carbon molten bath 12 is produced in the arc furnace 10, it is possible to use, as the scrap, lower scrap and scale, in combination, whose impurities may considerably largely change.

In addition, the production of the high-carbon molten bath 12 in the arc furnace 10 can be performed in the nighttime when electric power costs low.

Figures 1A, 1B, 1C:
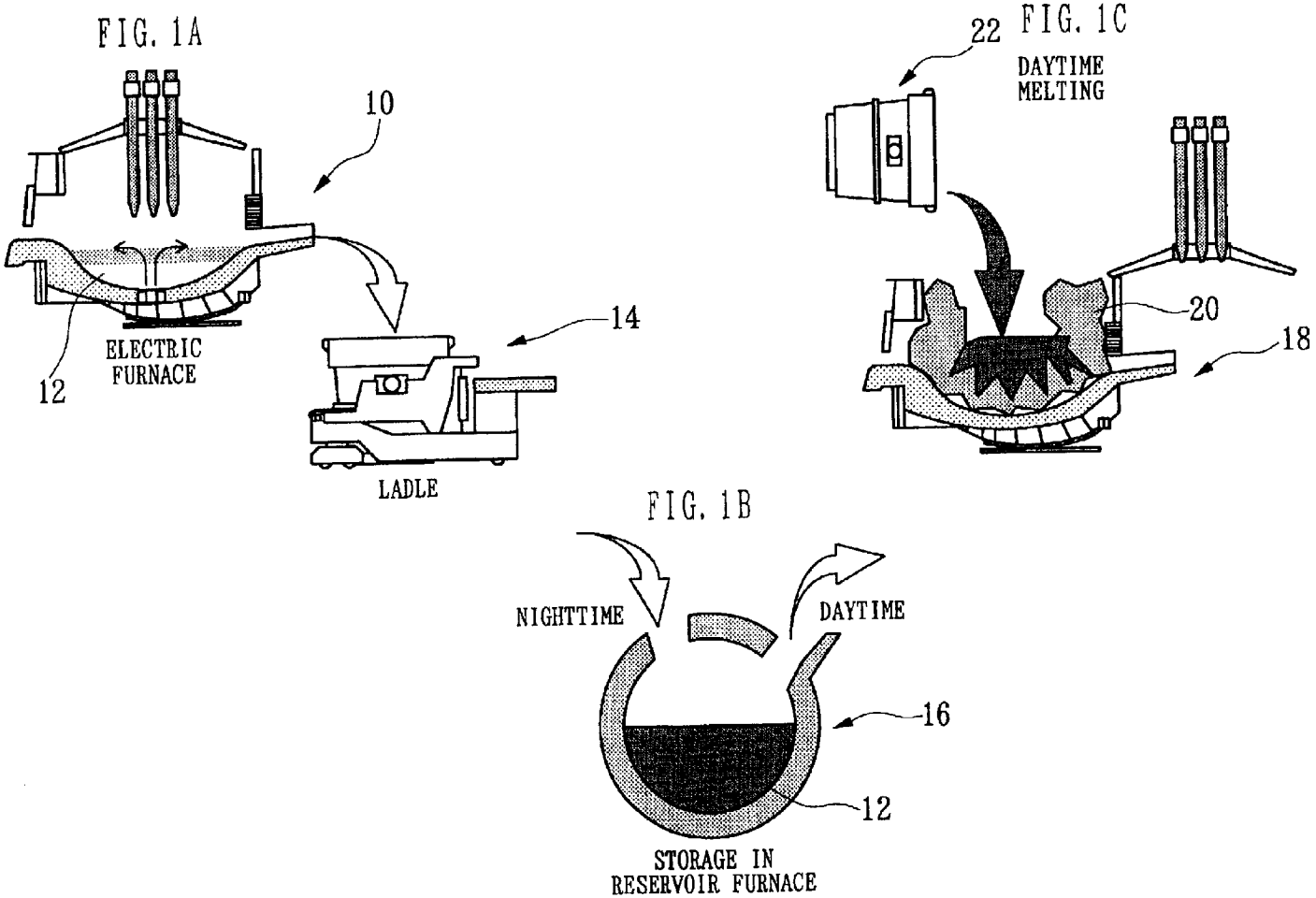
FIG. 1A is a view showing a first step of a molten steel producing method embodying the present invention.
FIG. 1B is a view showing a second step of the molten steel producing method.
FIG. 1C is a view showing a third step of the molten steel producing method.

All the high-carbon molten bath 12 thus produced in the arc furnace 10, i.e., one charge of high-carbon molten iron is taken from the furnace 10 into a ladle 14 and, as shown in FIG. 1B, the one-charge molten iron is transferred from the ladle 14 to a reservoir furnace 16 whose capacity is larger than that of the arc furnace 10, and thus a plurality of charges of molten iron are stored in the reservoir furnace 16.

The reservoir furnace 16 may be one whose capacity can store eight charges of molten iron each obtained as the high-carbon molten bath 12 in the arc furnace 10.

A temperature of those charges of molten iron stored in the reservoir furnace 16 can be kept, as needed, using, e.g., a burner.

Here, keeping the temperature means adding, to the reservoir furnace 16, external energy to compensate for the heat radiated from the furnace 16.

Since the arc furnace 10 is used as the furnace to produce the high-carbon molten bath 12, a temperature of the high-carbon molten iron taken from the molten bath 12 can be easily controlled. More specifically described, the temperature of the molten iron taken from the arc furnace 10 can be controlled to a high degree, e.g., 1,500° C.

Since the temperature of the high-carbon molten iron taken from the arc furnace 10 can thus be controlled to a high degree, a storable time, i.e., a time period during which the high-carbon molten iron can be stored in the reservoir furnace 16 can be increased.

The reservoir furnace 16 is used to simultaneously store a plurality of charges of molten iron each obtained as the high-carbon molten bath 12 in the arc furnace 10.

Then, a portion of the high-carbon molten iron stored in the reservoir furnace 16 is taken from the furnace 16 into another ladle 22 and, as shown in FIG. 1C, this portion is put together with scrap 20, in another arc furnace (electric furnace) 18, for mixed melting.

To this end, it is preferred to pour the high-carbon molten iron 12 from the ladle 22, into the arc furnace 18, at a timing when a percentage of a portion of the scrap 20 that has been molten in the arc furnace 18 is lower than 30%.

In addition, it is preferred to pour the high-carbon molten iron 12 into the arc furnace 18, as shown in FIG. 1C, such that the molten iron poured is surrounded by the scrap 20.

The scrap 20 is put, in the arc furnace 18, along a side wall and/or a bottom wall of the arc furnace 18. Alternatively, after a central portion of the scrap 20 put in the arc furnace 18 has been molten by arc melting, the high-carbon molten iron 12 is poured into the molten central portion of the scrap 20.

Thus, the thermal energy of the high-carbon molten iron 12 can be efficiently utilized for the mixed melting. In addition, damaging of refractories of the arc furnace 18 can be reduced.

Electric power is applied to the arc furnace 18 to produce arc heat and thereby perform the mixed melting.

Figure 2:
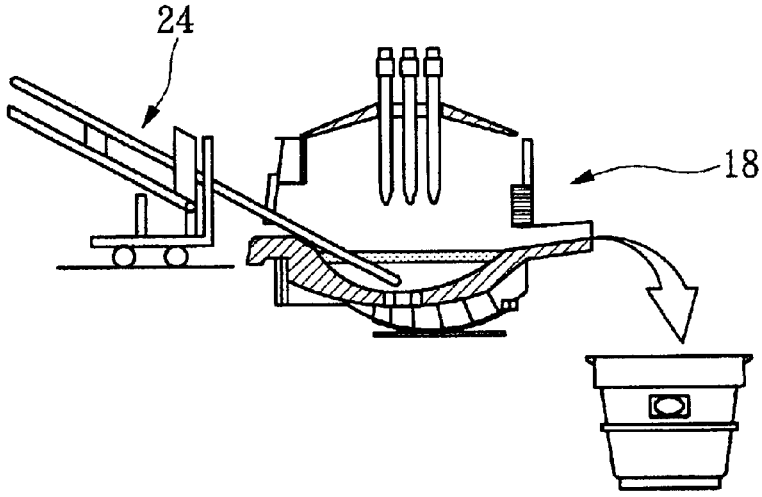
FIG. 2 is a view showing a fourth step of the molten steel producing method.

As shown in FIG. 2, at an appropriate timing during the mixed melting, a lance pipe 24 is deeply inserted into the molten steel, and oxygen gas is blown, through the lance pipe 24, into the molten steel to promote decarbonization of the molten steel.

The mixed melting in the arc furnace 18, i.e., a molten steel producing process is usually performed in the daytime when electric power costs high. However, since, in the present molten steel producing process, the high-carbon molten iron 12 itself has a lot of thermal energy and, in addition, since heat of reaction generated when CO and $CO_2$ are produced by the decarbonization can be effectively utilized, energy to be externally added can be minimized.

Thus, the mixed melting or the molten steel producing process can be carried out with the minimized energy.

Figure 3:
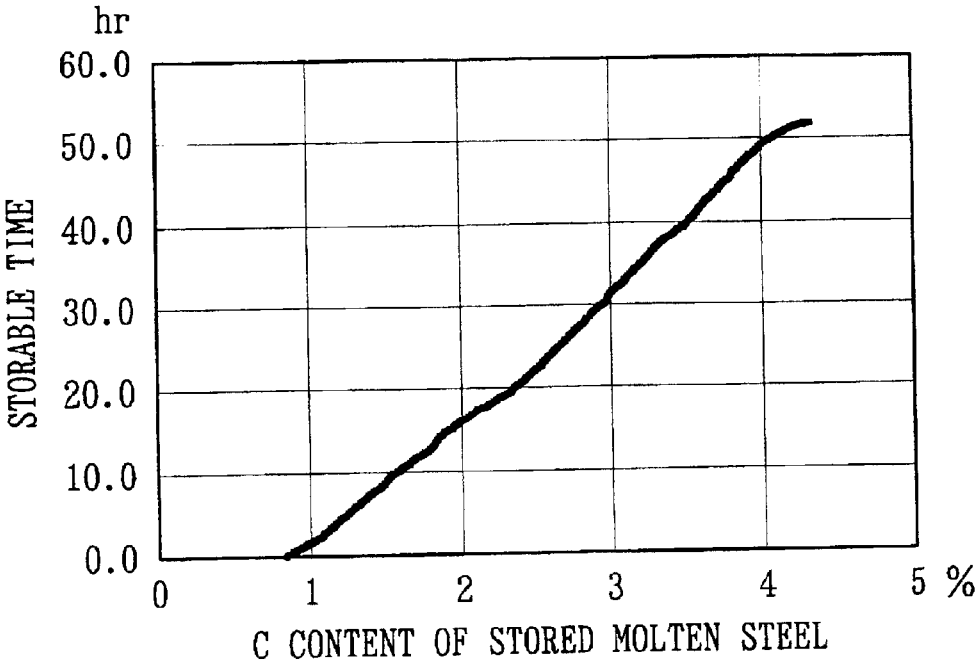
FIG. 3 is a graph showing a relationship between concentration of carbon of high-carbon molten steel, stored in a reservoir furnace shown in FIG. 1B, and storable time.

FIG. 3 shows a relationship between C content of high-carbon molten iron and storable time, that is obtained when the charges of high-carbon molten iron 12 taken from the arc furnace 10 whose capacity is about 80 t are stored (without addition of heat) in the reservoir furnace 16 whose capacity is about 700 t, under the following conditions:

<Conditions>

Size of Reservoir Furnace: 7 m diameter×8.8 m length

Thickness of Refractories: 880 mm

Heat Radiated from the Furnace: 15.1 Gcal/day

Temperature of Molten Steel Put in the Furnace: 1,500° C.

Capacity of Reservoir Furnace: 700 t

Specific Heat: 0.2 Mcal/t·° C.

The melting point of the high-carbon molten iron 12 changes with the C content thereof, such that as the C content increases, the melting or solidifying point lowers.

Those relationships are obtained from the following results:

<C Content (wt. %) and Storable Time>

| C % | Melting Point (° C.) | Storable Time (hr) |
|---|---|---|
| 0.45 | 1,494 | −2.2 |
| 1 | 1,470 | 1.6 |
| 1.5 | 1,425 | 8.7 |
| 2 | 1,380 | 15.9 |
| 2.5 | 1,340 | 22.3 |
| 3 | 1,280 | 31.8 |
| 3.5 | 1,225 | 40.5 |
| 4 | 1,170 | 49.3 |
| 4.3 | 1,153 | 52.0 |

The above results show that in consideration of a handling time essentially needed to put the high-carbon molten iron 12 in the reservoir furnace 16 and take the molten iron 12 from the furnace 16, the molten iron 12 can be stored in the furnace 16 for a substantially effective time, when the C content of the molten iron 12 is not lower than 1%.

For example, FIG. 3 shows that when the C content of the high-carbon molten iron 12 is 1.5%, the molten iron 12 can be stored in the reservoir furnace 16 for about 10 hours. Therefore, at an appropriate timing or timings during this time period, the molten iron 12 can be taken from the reservoir furnace 16 so as to be used in a steel producing furnace to produce a molten steel.

The high-carbon molten iron 12 whose C content is about 1.5% can be used as a seed steel for producing a stainless steel. Therefore, the high-carbon molten iron 12 whose C content is about 1.5% can be taken, as needed, from the reservoir furnace 16, so that the molten iron 12 is smelted or decarbonized by, e.g., an AOD furnace to produce a stainless steel.

That is, according to the present invention, not only the electric furnace but also other sorts of furnaces such as the AOD furnace can be used as the steel producing furnace.

As previously described, when the high-carbon molten iron 12 is produced in the arc furnace 10, the scrap as the iron material, and the carbon material are put in the arc furnace 10, and are molten under a reducing condition. Therefore, it is possible to use, as the iron material, not only the scrap but also scale that contains iron oxides as main components thereof.

In the above-indicated case, the scale to be disposed of can be effectively utilized as the material to produce steel, which contributes to reducing the overall cost of the steel material.

Figure 4:
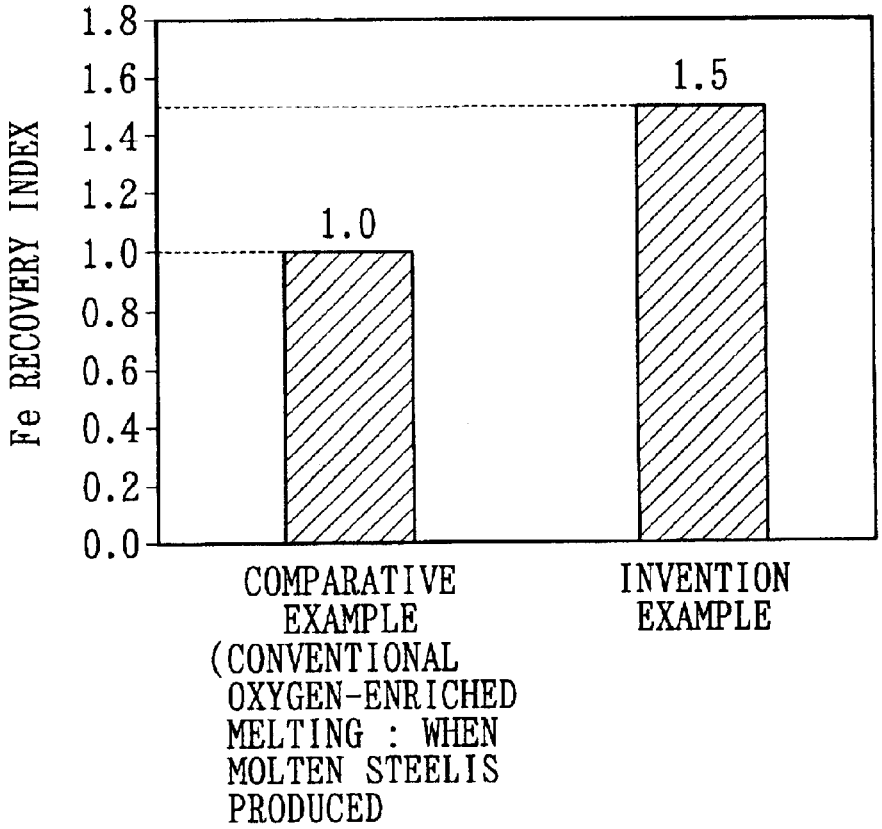
FIG. 4 is a graph showing respective iron recovery index values of an invention example, and a comparative example wherein scale is used as iron material.

FIG. 4 shows, when it is assumed that an iron recovery index value of a molten steel (comparative example) obtained by using scrap as iron material in a conventional method using an arc furnace is 1, an iron recovery index value of a molten steel obtained by using scale as iron material according to the present invention.

More specifically described, the Fe recovery index value of the invention example, shown in FIG. 4, is obtained under the following conditions: One charge of molten iron is obtained by putting 70 t of scrap, 30 t of scale, and 1,500 kg of carbon material in the arc furnace 10, and operating the arc furnace 10 to produce the high-carbon molten iron 12 whose C content ranges from 2 to 4% by weight; and the Fe recovery index value (i.e., 1) of the comparative example is obtained under the following conditions: One charge of molten iron is obtained by putting 90 t of scrap in an arc furnace, and operating the arc furnace in a conventional method.

FIG. 4 shows that the iron recovery index is increased to 1.5 times by using scale as iron material according to the present invention.

As described previously, the reservoir furnace 16 simultaneously stores a plurality of (e.g., 8) charges of high-carbon molten iron 12 each taken from the arc furnace 10.

As a result, even if impurities contained in one charge of molten iron may largely differ from those of another charge of molten iron, those differences among the respective impurities of the respective charges of molten iron are leveled off, or averaged because those charges of molten iron are stored in the reservoir furnace 16.

Hereinafter, this feature will be explained in more detail by reference to actually produced molten steels.

Here, brand, H2 Kozan scrap, as an example of lower scrap and brand, Shindachi scrap, as an example of higher scrap, both shown in Table 1, are used to produce 15 charges of high-carbon molten iron 12, under conditions shown in Table 2, and respective Cu contents as respective impurities contained in the 15 charges of molten iron 12 thus produced are measured.

Table 3 shows respective measurement results together with respective scrap proportions.

Here, a scrap proportion means a percentage of the H2 Kozan scrap included in a scrap mixture that additionally includes the Shindachi scrap, cutting scrap, scrap produced in a factory, etc.

TABLE 1

Content of Impurity of Typical Scrap Brand

| | Brand | [Cu] Concentration |
|---|---|---|
| Lower Scrap | H2 Kozan | 0.41 ± 0.4 % |
| Higher Scrap | Shindachi | <0.06 % |

TABLE 2

Conditions for Producing High-Carbon Molten Iron

| Type of Furnace | Three-Phase Alternating-Current Arc Furnace |
|---|---|
| Nominal Capacity of Furnace | 70 t |
| Actually Input Amount of Scrap | 85 t/per charge |
| H2 Kozan Scrap Proportion | from 34% to 46% |

TABLE 3

Measurements on Produced Charges of High-[C] Molten Iron

| No. | Total Input Amount (ton) | H2 Kozan Proportion (%) | [% C] | [% Cu] |
|---|---|---|---|---|
| 1 | 85.6 | 38 | 3.73 | 0.18 |
| 2 | 90.7 | 34 | 3.99 | 0.18 |
| 3 | 87.5 | 35 | 3.94 | 0.15 |
| 4 | 86.7 | 34 | 3.98 | 0.12 |
| 5 | 87.4 | 35 | 3.83 | 0.19 |
| 6 | 87.3 | 34 | 3.70 | 0.25 |
| 7 | 86.8 | 40 | 4.28 | 0.16 |
| 8 | 87.4 | 39 | 3.95 | 0.20 |
| 9 | 86.8 | 41 | 3.77 | 0.14 |
| 10 | 87.3 | 46 | 3.46 | 0.18 |
| 11 | 86.9 | 40 | 4.28 | 0.16 |
| 12 | 87.1 | 35 | 3.98 | 0.17 |
| 13 | 87.3 | 39 | 3.97 | 0.21 |
| 14 | 87.3 | 39 | 3.90 | 0.18 |
| 15 | 87.2 | 36 | 3.33 | 0.19 |

Figure 5A:
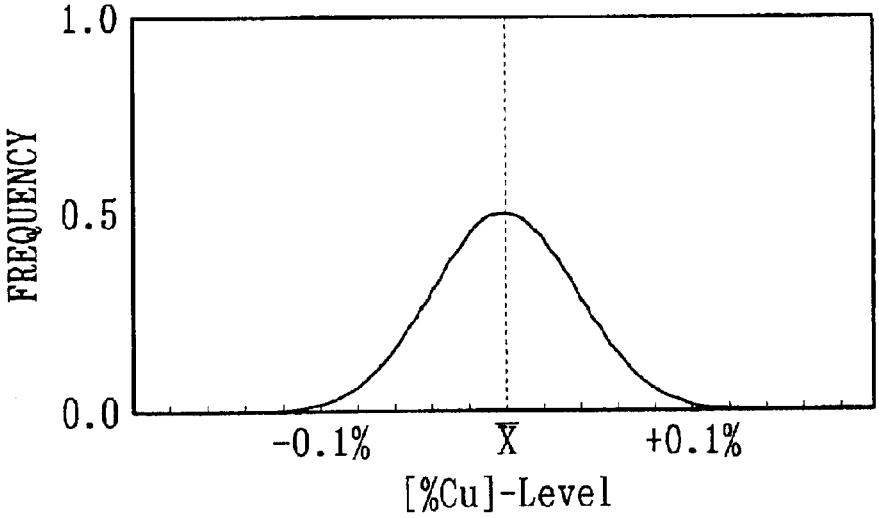
FIG. 5A is a graph showing a dispersion of respective Cu concentrations of a plurality of charges of molten steel that are obtained by a molten-steel-production experiment.

FIG. 5A shows a relationship between Cu concentration and number of charges (frequency) of high-carbon molten iron, that is obtained from Table 3. Table 3 or FIG. 5A shows that since the H2 Kozan scrap as the lower-scrap brand is used, the concentration of Cu as impurity largely changes among the respective charges of high-carbon molten iron.

As can be understood from Table 3, the present experiment aims at producing charges of high-carbon molten iron 12 whose C contents are about 4%, using the arc furnace 10.

As can be understood from FIG. 3, the high-carbon molten iron 12 whose C content is 4% can be stored in the reservoir furnace 16, for about 50 hours.

Table 4 shows respective measured Cu concentrations of respective output baths taken from the reservoir furnace 16 that simultaneously stores 6 charges (ch) of high-carbon molten metal 12 each produced in the arc furnace 10.

As can be understood from Table 4, although respective measured Cu concentrations of the respective charges of high-carbon molten iron (input baths) largely differ from each other, the respective measured Cu concentrations of the respective batches of high-carbon molten iron 12 (output baths) taken from the reservoir furnace 16 are substantially equal to one another.

That is, although the respective Cu concentrations of the respective charges of high-carbon molten iron may largely differ from each other, those differences of the Cu concentrations are averaged because the plurality of (e.g., 6) charges of high-carbon molten iron are simultaneously stored in the reservoir furnace 16.

TABLE 4

[% Cu] of Input and Output Baths to and from Reservoir Furnace

| | Input Baths | | | | | | Output Baths | |
|---|---|---|---|---|---|---|---|---|
| | 1ch | 2ch | 3ch | 4ch | 5ch | 6ch | Estimated Average | Actual Average |
| ① [% Cu] | 0.18 | 0.18 | 0.15 | 0.12 | 0.19 | 0.25 | 0.18 | 0.18 |
| ② [% Cu] | 0.13 | 0.18 | 0.29 | 0.11 | 0.13 | 0.25 | 0.18 | 0.18 |

Figure 5B:
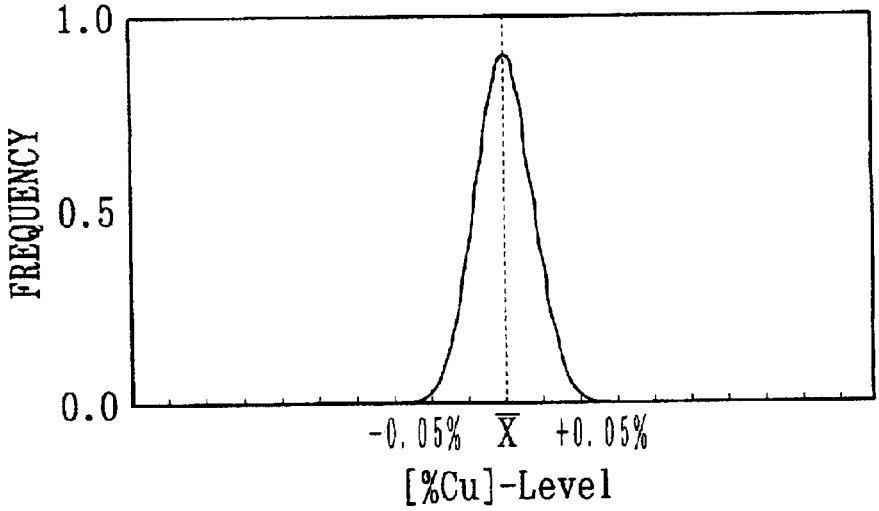
FIG. 5B is a graph showing a dispersion of respective Cu concentrations of a plurality of charges of molten steel that are obtained by mixed melting of high-carbon molten steel and scrap.

FIG. 5B shows a dispersion of respective Cu concentrations of molten steels obtained by mixed melting of the high-carbon molten iron 12 and the scrap 20.

In FIG. 5B, the dispersion of the Cu concentrations is small because the plurality of charges of high-carbon molten iron 12 are simultaneously stored in the reservoir furnace 16 and the respective Cu concentrations of those charges of molten iron are averaged.

As can be understood from FIG. 5B, according to the present process (the molten-steel producing method), the dispersion of the respective Cu concentrations of final products can be largely reduced, even if the H2 Kozan scrap as the lower scrap may be used.

In other words, according to the invention process, a molten steel having an excellent quality can be produced using the H2 Kozan as the lower scrap that has been difficult to use in the conventional process, or that has been difficult to use in a large amount in the conventional process.

While the present invention has been described in detail in its preferred embodiments, it is to be understood that the present invention is by no means limited to the details of the described embodiments, and may be embodied with various changes that may occur to a person skilled in the art, without departing from the spirit and scope of the invention defined in the appended claims.

What is claimed is:

1. A method of producing steel, comprising:

putting an iron material and a carbon material into first electric furnace;

melting the iron material and the carbon material;

producing a high-carbon molten iron whose carbon content is at least 1;

removing the high-carbon molten iron from the first electric furnace;

storing in a reservoir furnace an amount of the high-carbon molten iron that corresponds to a plurality of charges of the first electric furnace; and producing molten steel in a steel producing furnace using a portion of the high-carbon molten iron stored in the reservoir furnace.

2. The method according to claim 1, wherein producing the molten steel from the high-carbon molten iron comprises putting said high-carbon molten iron and scrap in the steel producing furnace.

3. The method according to claim 1, wherein producing molten steel in the steel producing furnace comprises producing molten steel in a second electric furnace different from said first electric furnace.

4. The method according to claim 1, wherein said iron material comprises scrap.

5. The method according to claim 4, wherein said iron material comprises scrap and scale.

* * * * *